US010123629B2

(12) United States Patent
Choi

(10) Patent No.: US 10,123,629 B2
(45) Date of Patent: Nov. 13, 2018

(54) FOLDABLE SUPPORTING FRAMES

(71) Applicant: Inno-Sports Co., Ltd., Xiamen (CN)

(72) Inventor: Kwanjun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 270 days.

(21) Appl. No.: 15/144,575

(22) Filed: May 2, 2016

(65) Prior Publication Data

US 2016/0316922 A1 Nov. 3, 2016

(30) Foreign Application Priority Data

Apr. 30, 2015 (CN) ..... 2015 2 0274396 U
Nov. 25, 2015 (CN) ..... 2015 2 0949832 U

(51) Int. Cl.
*A47C 19/02* (2006.01)
*A47C 19/12* (2006.01)

(52) U.S. Cl.
CPC ..... *A47C 19/122* (2013.01); *A47C 19/025* (2013.01)

(58) Field of Classification Search
CPC ..... A47C 19/02; A47C 23/005
USPC ..... 5/202, 249, 246, 400
See application file for complete search history.

(56) References Cited

U.S. PATENT DOCUMENTS 1,196,253 A 8/1916 Lowy
6,151,730 A 11/2000 Weston
9,226,590 B1 * 1/2016 Hull ..... F16B 12/56
2011/0073723 A1 3/2011 Ashpole
2013/0067659 A1 3/2013 Oh
2013/0067862 A1 3/2013 Oh
2014/0345044 A1 11/2014 Murphy

OTHER PUBLICATIONS

U.S. Appl. No. 14/775,107, dated Dec. 16, 2015.
U.S. Appl. No. 15/144,597, filed May 2, 2016.
U.S. Appl. No. 15/056,150, filed Feb. 29, 2016.
U.S. Appl. No. 15/114,471, filed May 2, 2016.
U.S. Appl. No. 15/144,471, filed May, 2, 2016.
U.S. Appl. No. 15/820,754, filed Nov. 22, 2017.
U.S. Appl. No. 15/820,848, filed Nov. 22, 2017.
U.S. Appl. No. 15/423,251, filed Feb. 2, 2017.
U.S. Appl. No. 15/640,810, filed Jul. 3, 2017.
U.S. Appl. No. 15/663,522, filed Jul. 28, 2017.
U.S. Appl. No. 15/809,161, filed Nov. 10, 2017.

* cited by examiner

*Primary Examiner* — Fredrick C Conley
(74) *Attorney, Agent, or Firm* — Morgan, Lewis & Bockius LLP

(57) ABSTRACT

A foldable supporting frame includes first and second frame units, each with an upper frame, a lower frame, and supports pivotally connected to the upper and lower frames and supporting the upper frame when the foldable supporting frame is unfolded. The foldable supporting frame also includes upper links for pivotally connecting the upper frames of the first and second units and lower links for pivotally connecting the lower frames of the first and second units. Upper and lower links are separated from each other, reducing the overall weight and facilitating smooth folding and unfolding of the supporting frame.

17 Claims, 14 Drawing Sheets

FOLDABLE SUPPORTING FRAMES

CROSS-REFERENCE TO RELATED APPLICATIONS

The present application claims priority of Chinese Utility Model Applications: CN 201520274396.9, filed Apr. 30, 2015; and CN 201520949832.8 filed Nov. 25, 2015, the disclosures of which are incorporated herein for all purposes by reference.

FIELD OF THE INVENTION

The present invention generally relates to foldable supporting frames, and more particularly, to foldable supporting frames having supports and links.

BACKGROUND

A typical foldable supporting frame is made of two frame units, each having an upper frame and a lower frame. The upper and lower frames of the two frame units are pivotally connected to each other through a plate formed with pivotal holes. An example of such a supporting frame is disclosed in U.S. Publication No. 2013/0067862. To facilitate the folding and unfolding of the supporting frame, the pivotal holes for connecting the upper frames of the two frame units are generally positioned with a distance different from that of the pivotal holes for connecting the lower frames of the two frame units. This requires a large plate, sufficiently wide and long for the formation of the pivotal holes, and thus increases the overall size and weight of the foldable supporting frame. In addition, as the upper and lower frames of the two frame units rotates around the pivotal holes formed on the plate, folding and unfolding of the supporting frame is not smooth. The supporting frame when folded is not compact.

Given the current state of the art, there remains a need in the art for supporting frames and related components that are stable, easier to use, and configured for convenient packaging, shipping and transportation.

The information disclosed in this Background section is provided for an understanding of the general background of the invention and is not an acknowledgement or suggestion that this information forms part of the prior art already known to a person skilled in the art.

SUMMARY

The present invention provides supporting frames and related components that are improved over existing options; they are stable, easier to use, and configured for convenient packaging, shipping and transportation.

In various embodiments, the present invention provides a foldable supporting frame including first and second frame units pivotally connected to each other by a plurality of links. Each of the first and second frame unit includes an upper frame, a lower frame, and a plurality of supports. The upper frame has an upper proximal end at each of left and right sides of the foldable supporting frame. The lower frame is disposed below the upper frame when the foldable bed frame is unfolded, and has a lower proximal end at each of the left and right sides of the foldable supporting frame. The plurality of supports is pivotally connected to the upper and lower frames and supports the upper frame when the foldable supporting frame is unfolded. The plurality of links includes an upper link and a lower link at each of the left and right sides of the foldable supporting frame. The upper link is pivotally connected to the upper proximal ends of the first and second frame units. The lower link is separated from the upper link and pivotally connected to the lower proximal ends of the first and second frame units.

In some embodiments, the upper link includes first and second upper segments. The first upper segment is elongated in a longitudinal direction of the foldable supporting frame, pivotally connected to the upper proximal end of the first frame unit at a first upper pivot point, and pivotally connected to the upper proximal end of the second frame unit at a second upper pivot point. The second upper segment is substantially perpendicular to the first upper segment, disposed below the upper proximal ends of the first and second frame units when the foldable supporting frame is unfolded, and supports the upper proximal ends of the first and second frame units.

In one embodiment, the lower link includes first and second lower segments. The first lower segment is pivotally connected to the lower proximal end of the first frame unit at a first lower pivot point, and pivotally connected to the lower proximal end of the second frame unit at a second lower pivot point. The second lower segment is substantially perpendicular to the first lower segment, disposed below the lower proximal ends of the first and second frame units when the foldable supporting frame is unfolded, and supports the upper proximal ends of the first and second frame units.

In another embodiment, the lower link includes first and second lower pieces. The first lower piece has a lower segment and an upper segment. The lower segment of the first piece is pivotally connected to the lower proximal end of the first frame unit at a first lower pivot point, and pivotally connected to the lower proximal end of the second frame unit at a second lower pivot point. The second lower piece has a first end pivotally connected to the upper segment of the first lower piece and a second end pivotally connected to a support adjacent the lower proximal end of the first or second frame unit. In one embodiment, the lower and upper segments of the first lower piece collectively form a "Z" shape. Preferably, the first lower piece is bent such that the lower and upper segments of the first lower piece form a step.

In a preferred embodiment, a distance between the first upper pivot and the second upper pivot is longer than a distance between the first lower pivot and the second lower pivot.

In some embodiments, a support in the plurality of supports includes a first segment and a second segment collectively forming a substantial "L" shape. In some embodiments, the support further includes one or more third segments extended and bent from an edge of the first segment. The second segment and the one or more third segments are located on the same side of the first segment. When the foldable supporting frame is unfolded, the one or more third segments abut the upper and lower frames.

In some embodiments, at least one support has the first segment pivotally connected to the upper frame, and the second segment pivotally connected to the lower frame. In some embodiments, at least one support has the first segment pivotally connected to the lower frame, and the second segment pivotally connected to the upper frame. In some embodiments, each support disposed adjacent the proximal ends has the first segment pivotally connected to the upper frame, and the second segment pivotally connected to the lower frame; and each support disposed away from the proximal ends has the first segment pivotally connected to the lower frame, and the second segment pivotally connected to the upper frame.

In an embodiment, the first segment of a support adjacent the proximal ends is formed with a raised or recessed terrace for connecting with the lower link.

In some embodiments, the upper frame of each of the first and second frame units includes an upper interior longitudinal bar having an upper interior proximal end between left and right sides of the foldable supporting frame. In some embodiments, the plurality of links includes an upper link pivotally connected to the upper interior proximal ends of the first and second frame units.

In some embodiments, the upper frame includes a plurality of longitudinal upper bars, and the lower frame includes a plurality of longitudinal lower bars corresponding to the plurality of longitudinal upper bars, where each support in the plurality of supports is disposed between a longitudinal upper bar and a corresponding longitudinal lower bar and pivotally connected to the longitudinal upper and lower bars.

In some embodiments, the upper frame is formed with a hole adjacent the upper proximal end for connecting with a support, and the lower frame is formed with a hole adjacent the lower proximal end for connecting with the support, wherein the hole of the lower frame is positioned closer to a central line than the hole of the upper frame.

In some embodiments, the upper frame includes an upper peripheral frame and at least one upper interior bar, and the lower frame includes a lower peripheral frame and at least one lower interior bar. In some embodiments, the upper frame includes an upper peripheral frame made of a bent bar, and the lower frame includes a lower peripheral frame made of a bent bar.

The supporting frames of the present invention have other features and advantages that will be apparent from or are set forth in more detail in the accompanying drawings, which are incorporated herein, and the following Detailed Description, which together serve to explain certain principles of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
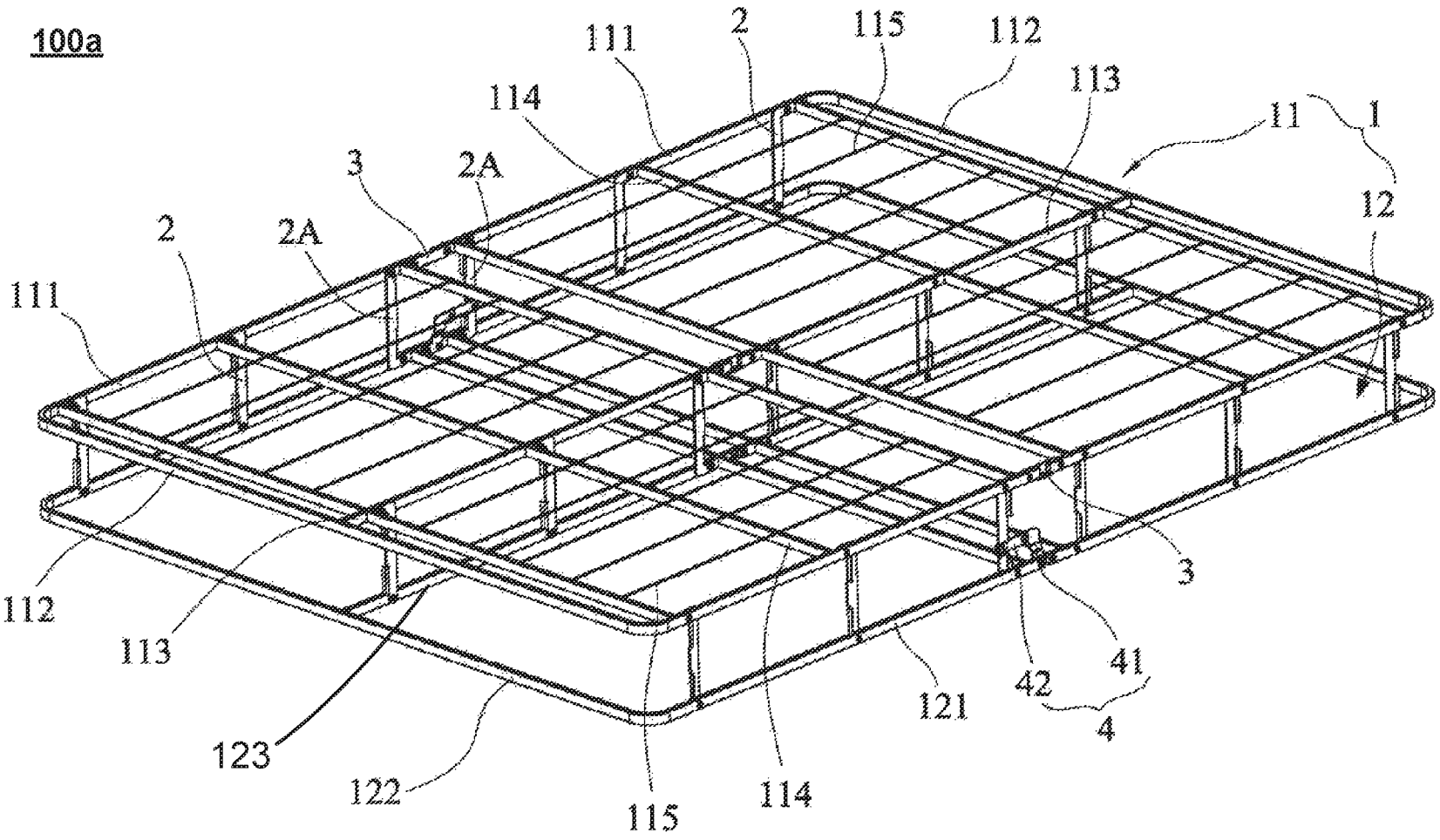
FIG. 1 is a schematic perspective view illustrating an exemplary foldable supporting frame in an unfolded state in accordance with some embodiments of the present invention.
Figure 2:
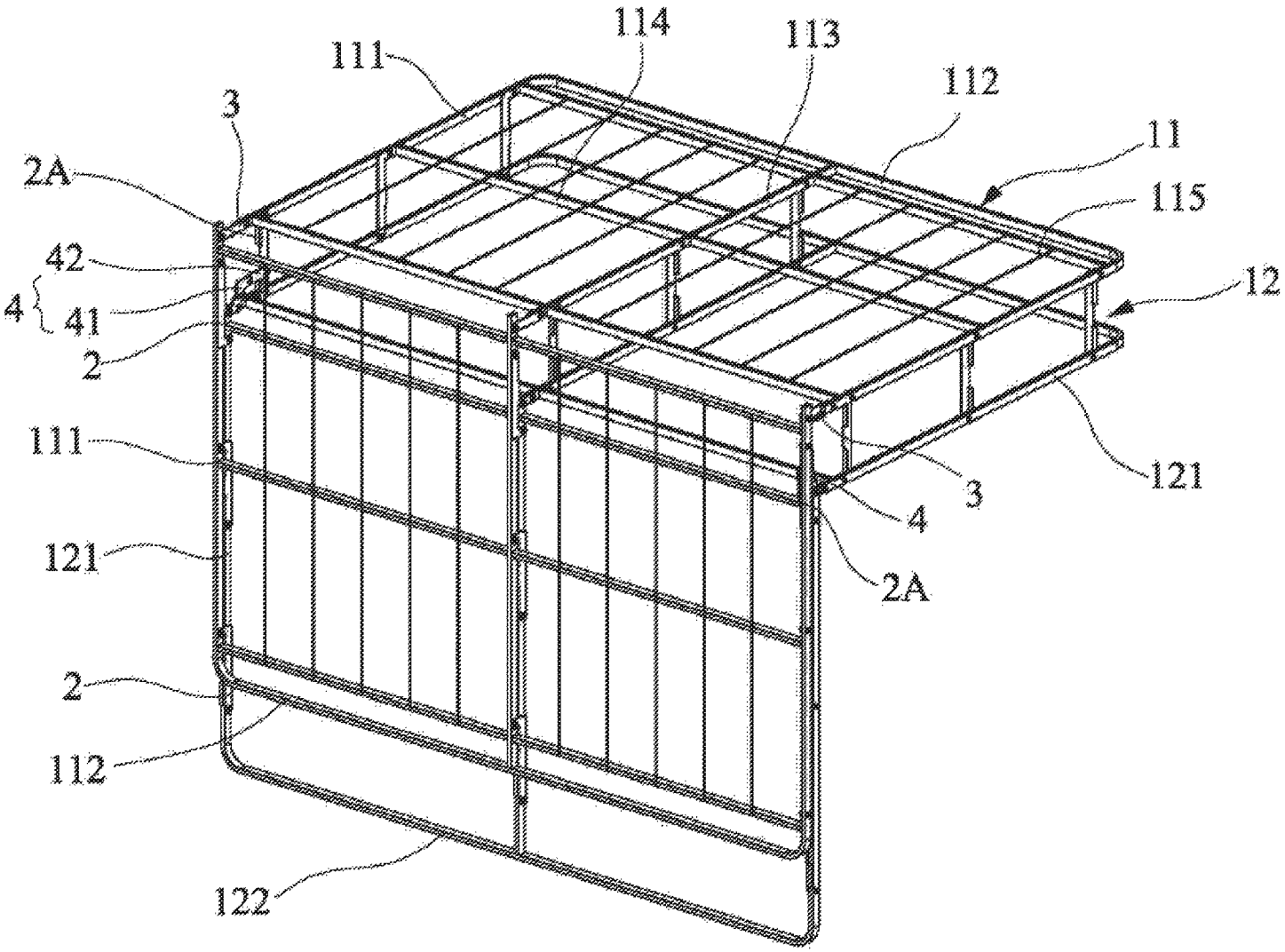
FIG. 2 is a schematic perspective view illustrating the exemplary foldable supporting frame of FIG. 1 between an unfolded state and a folded state in accordance with some embodiments of the present invention.

Reference will now be made in detail to implementations of the present application as illustrated in the accompanying drawings. The same reference indicators will be used throughout the drawings and the following detailed description to refer to the same or like parts. Those of ordinary skill in the art will realize that the following detailed description of the present application is illustrative only and is not intended to be in any way limiting. Other embodiments of the present application will readily suggest themselves to such skilled persons having benefit of this disclosure.

In the interest of clarity, not all of the routine features of the implementations described herein are shown and described. It will be appreciated that in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of this disclosure can be made without departing from its spirit and scope, as will be apparent to those skilled in the art. The specific embodiments described herein are offered by way of example only.

Embodiments of the present invention are described in the context of supporting frames. The supporting frames can be of various sizes including but not limited to twin, full, queen and king sizes, and of various shapes including but not limited to rectangles and squares. Also, the supporting frames can be made of various materials including but not limited to metals such as steel, plastics and woods. The supporting frames can be used alone or in conjunction with bed frames. For example, the supporting frames can be placed on bed frames, before placing support mattresses, cushions, box springs or the like on the supporting frames, to increase the heights of the beds to accommodate users' different heights or preferences.

Generally, a supporting frame of the present invention includes two or more frame units pivotally connected to each other by a plurality of links. Each frame unit includes an upper frame, a lower frame and a plurality of supports disposed between the upper frame and lower frame. Each support is pivotally connected to the upper frame and the lower frame.

Referring now to FIGS. 1-3, 8, 11 and 14, there is depicted exemplary foldable supporting frames 100*a*, 100*b* in accordance with some embodiments of the present invention. As shown, a foldable supporting frame of the present invention includes a plurality of frame units such as first and second frame units 1 pivotally connected to each other by a plurality of links such as links 3 and 4. Each of the first and second frame units 1 includes an upper frame such as upper frame 11, a lower frame such lower frame 12, and a plurality of supports such as supports 2. The lower frame is disposed below the upper frame when the foldable bed frame is unfolded. The plurality of supports is disposed between the upper and lower frames, and pivotally connected to the upper and lower frames. The plurality of supports helps to support the upper frame when the foldable supporting frame is unfolded.

At each of left and right sides of the foldable supporting frame, the upper frame of each frame unit has an upper proximal end, and the lower frame of each frame unit has a lower proximal end. At each of left and right sides of the foldable supporting frame, the plurality of links includes an upper link such as upper link 3 for pivotally connecting the upper proximal ends of the first and second frame units and a lower link such as lower link 4 for pivotally connecting the lower proximal ends of the first and second frame units. In a preferred embodiment, upper link 3 and lower link 4 are separated from each other, e.g., they are individual pieces and are not directly connected to each other.

As used herein, the sides at which first and second frame units 1 are connected to each other are referred to as their proximal sides, and the sides opposite to the proximal sides are referred to as their distal sides. For instance, in FIG. 1, the proximal sides of first and second frame units are in the middle of the bed frame. The distal sides correspond to head and foot sections of the bed frame. The other two sides are referred to as left and right sides. It should be noted that the term "middle" as used herein does not necessarily mean the center of the bed frame, and the term "side" does not necessarily mean an outmost edge of the bed frame.

In some embodiments, upper frame 11 includes peripheral longitudinal and lateral bars such as upper peripheral longitudinal bar 111 and upper peripheral lateral bar 112. Upper peripheral longitudinal bar 111 and upper peripheral lateral bar 112 collectively define the peripheral of the upper frame. In a preferred embodiment, upper peripheral longitudinal bar 111 and upper peripheral lateral bar 112 are integrally made, e.g., by bending or of a bent bar. In some embodiments, upper frame 11 includes one or more interior bars disposed within the peripheral of the upper frame. By way of example, FIG. 1 illustrates upper frame 11 having interior longitudinal bar 113 and interior lateral bar 114. In some embodiments, interior longitudinal bar 113 of each frame unit has an upper interior proximal end. In an embodiment, such as the one illustrated in FIG. 1, the upper interior proximal ends of the first and second frame units are connected to each other by an upper link. In some embodiments, upper frame 11 includes one or more interior rods such as rod 115.

Similarly, in some embodiments, lower frame 12 includes peripheral longitudinal and lateral bars such as lower peripheral longitudinal bar 121 and lower peripheral lateral bar 122. Lower peripheral longitudinal bar 121 and lower peripheral lateral bar 122 collectively define the peripheral of the lower frame. In a preferred embodiment, lower peripheral longitudinal bar 121 and lower peripheral lateral bar 122 are integrally made, e.g., by bending or of a bent bar. In some embodiments, lower frame 12 further includes one or more interior bars disposed within the peripheral of the lower frame. By way of example, FIG. 1 illustrates lower frame 12 having interior longitudinal bar 123.

In some embodiments, the plurality of supports 2 is disposed between upper and lower longitudinal bars such as peripheral longitudinal bar 111 and upper peripheral lateral bar 112. In some embodiments, supports are also disposed between interior longitudinal bars such as between interior longitudinal bars 113 and 123. The number of supports 2 disposed between a pair of upper and lower longitudinal bars can be one, two, three or more. The supports can be evenly or unevenly distributed. By way of example, FIG. 1 illustrates three supports disposed between each pair of upper and lower longitudinal bars.

Figure 6A:
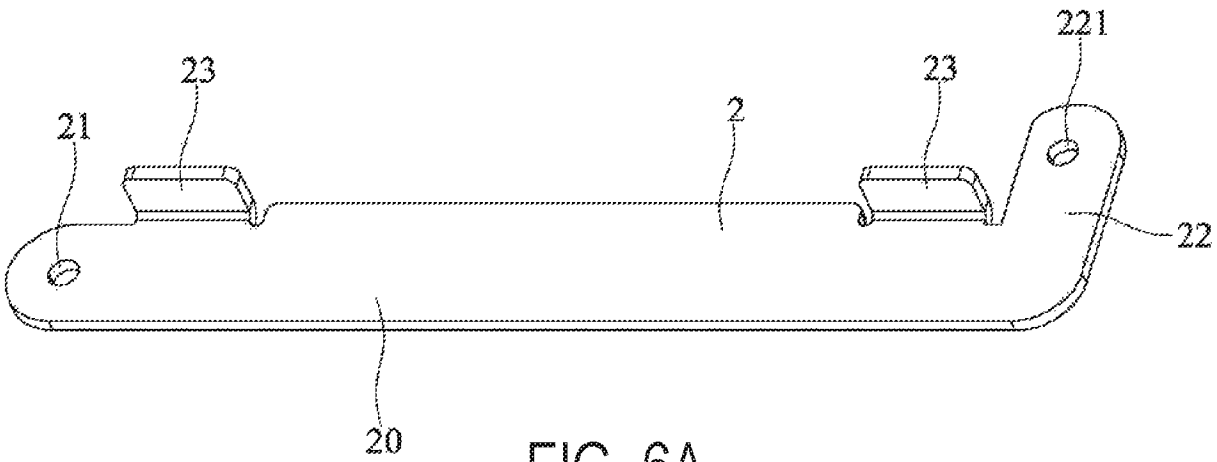
FIG. 6A is a schematic perspective view illustrating an exemplary support in accordance with some embodiments of the present invention.
Figure 6B:
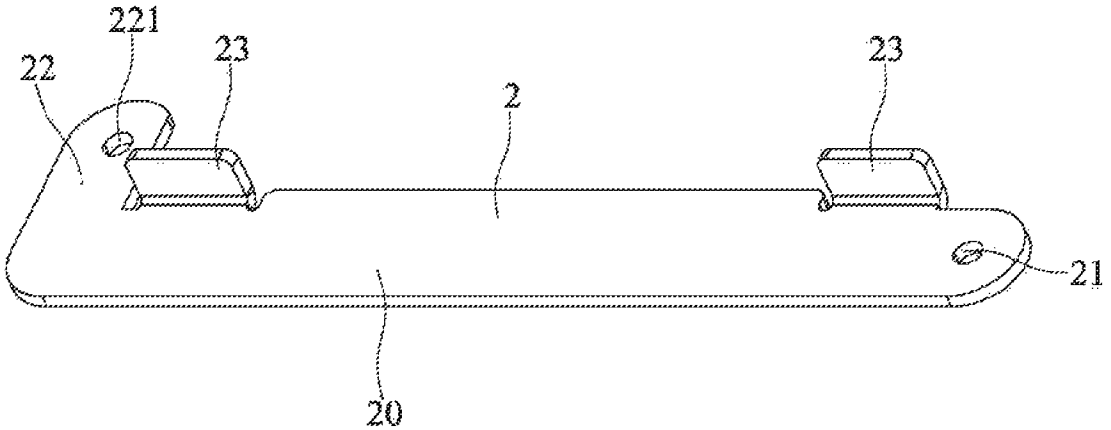
FIG. 6B and FIG. 6C are schematic perspective views illustrating variations of the exemplary support in FIG. 6A.
Figure 6C:
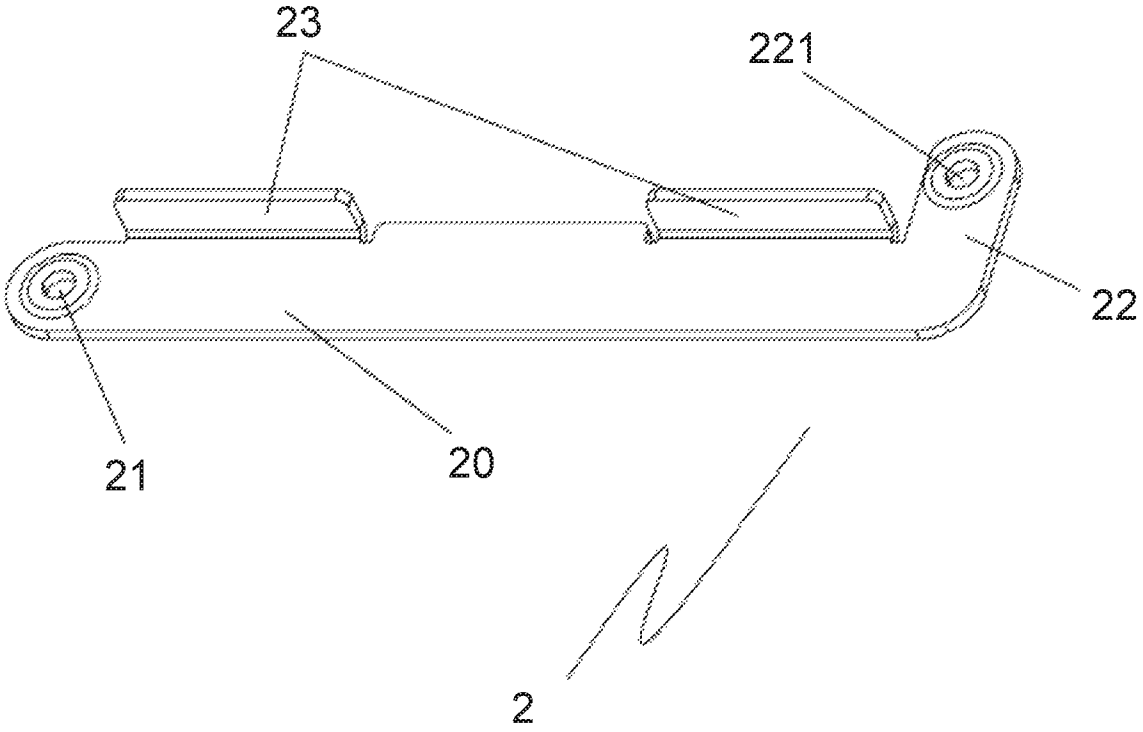

Referring to FIGS. 6A-6C, there is depicted exemplary supports in accordance with some embodiments of the present invention. As shown, support 2 has a first segment such as first segment 20 and a second segment such as second segment 21. In a preferred embodiment, first segment 20 and second segment 21 collectively form a "L" shape. In some embodiments, support 2 further includes one or more third segments such as third segment 23. By way of illustration, FIGS. 6A-6C show two third segments 23. Third segment 23 can have any suitable length. For example, third segment 23 illustrated in FIGS. 6A and 6B is relatively shorter and third segment 23 illustrated in FIG. 6C is relative longer. In a preferred embodiment, third segment 23 is extended and bent from an edge of first segment 20. The bending can be in either directions, as illustrated in FIGS. 6A and 6B. In some embodiments, third segment 23 and second segment 22 are located on the same side of first segment 20. When the foldable supporting frame is unfolded, the one or more third segments abut the upper and lower frames to help supporting the upper frames. In some embodiments, the first and second segments are formed with through holes such as holes 21 and 221 for connecting with the upper and lower frames.

Figure 3:
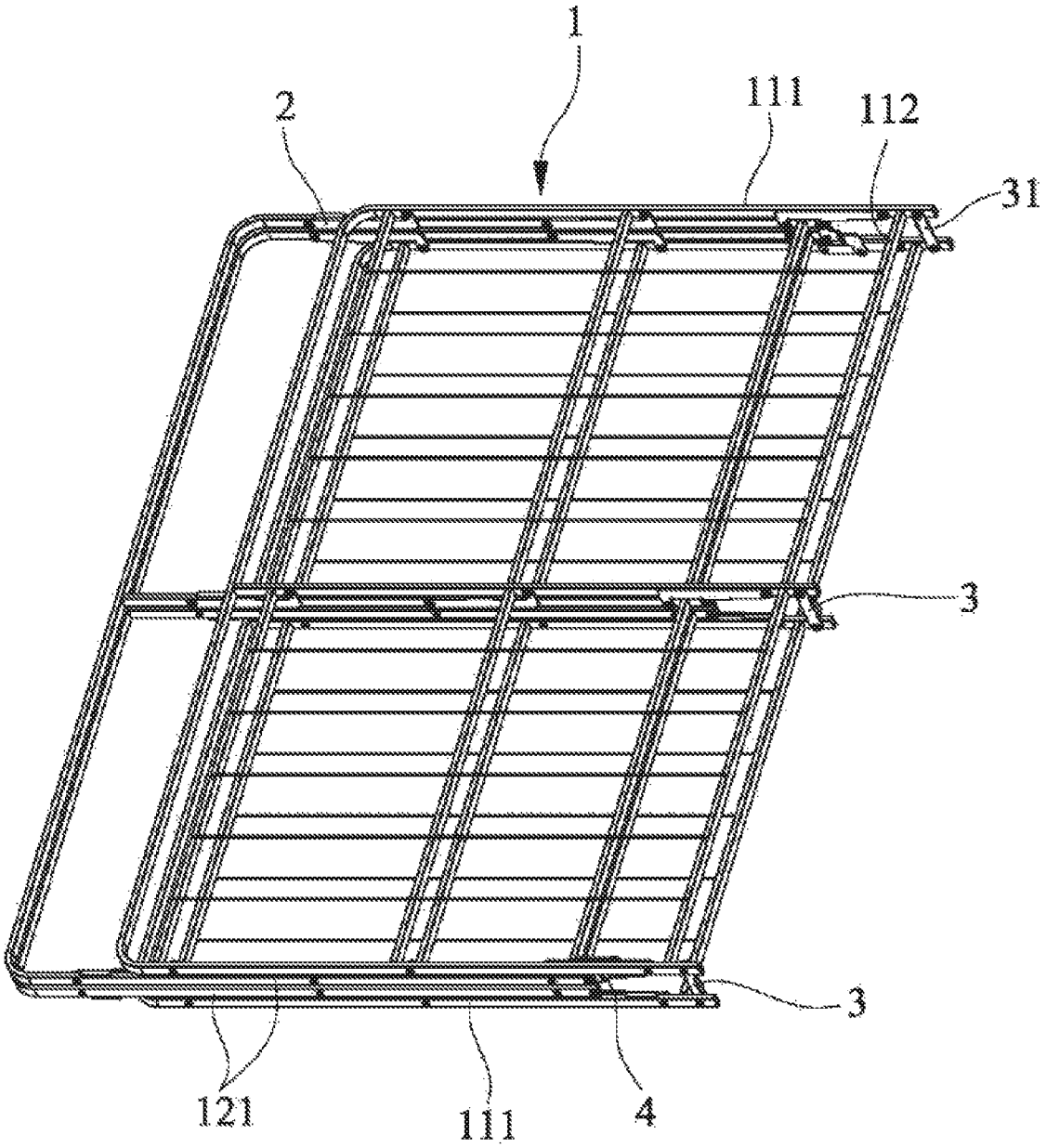
FIG. 3 is a schematic perspective view illustrating the exemplary foldable supporting frame of FIG. 1 in a folded state in accordance with some embodiments of the present invention.
Figure 7A:
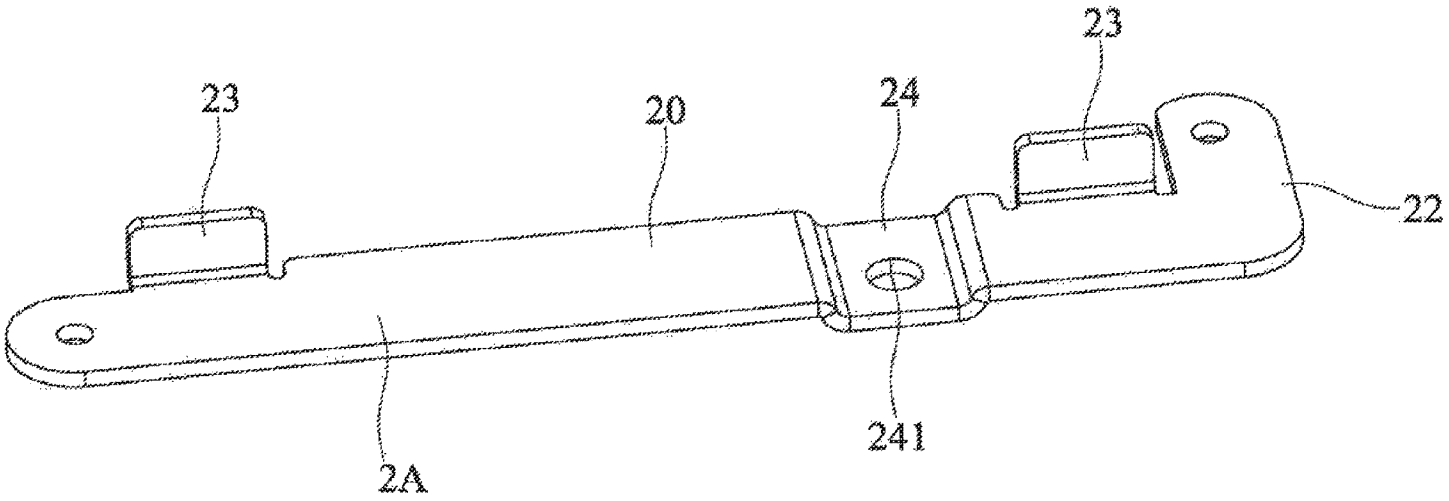
FIG. 7A is a schematic perspective view illustrating an exemplary support in accordance with some embodiments of the present invention.
Figure 7B:
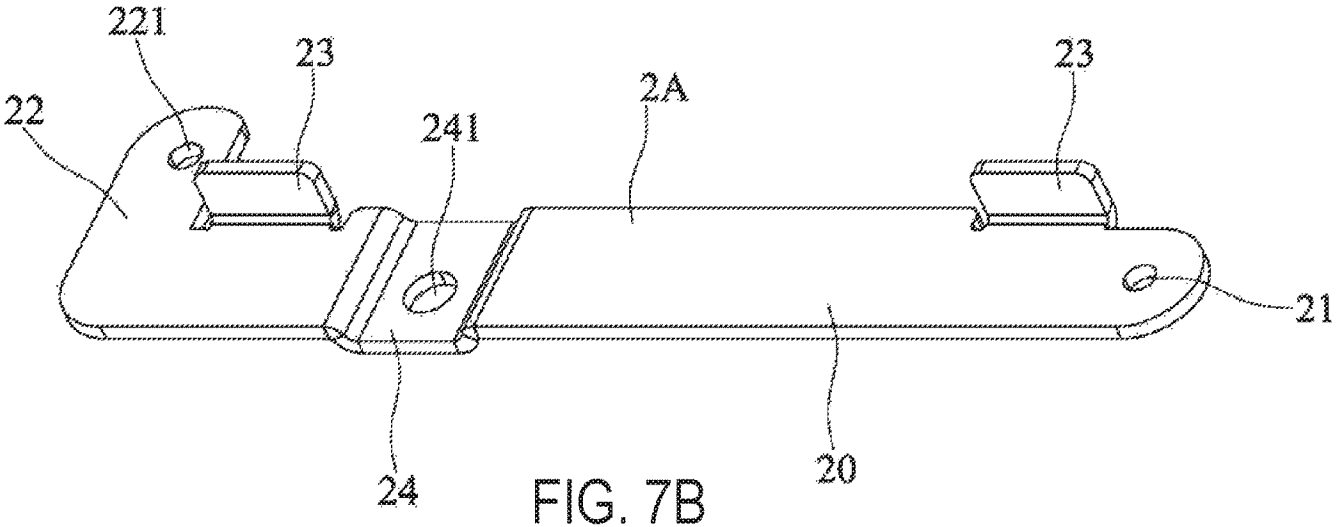
FIG. 7B is a schematic perspective view illustrating a variation of the exemplary support in FIG. 7B.
Figure 8:
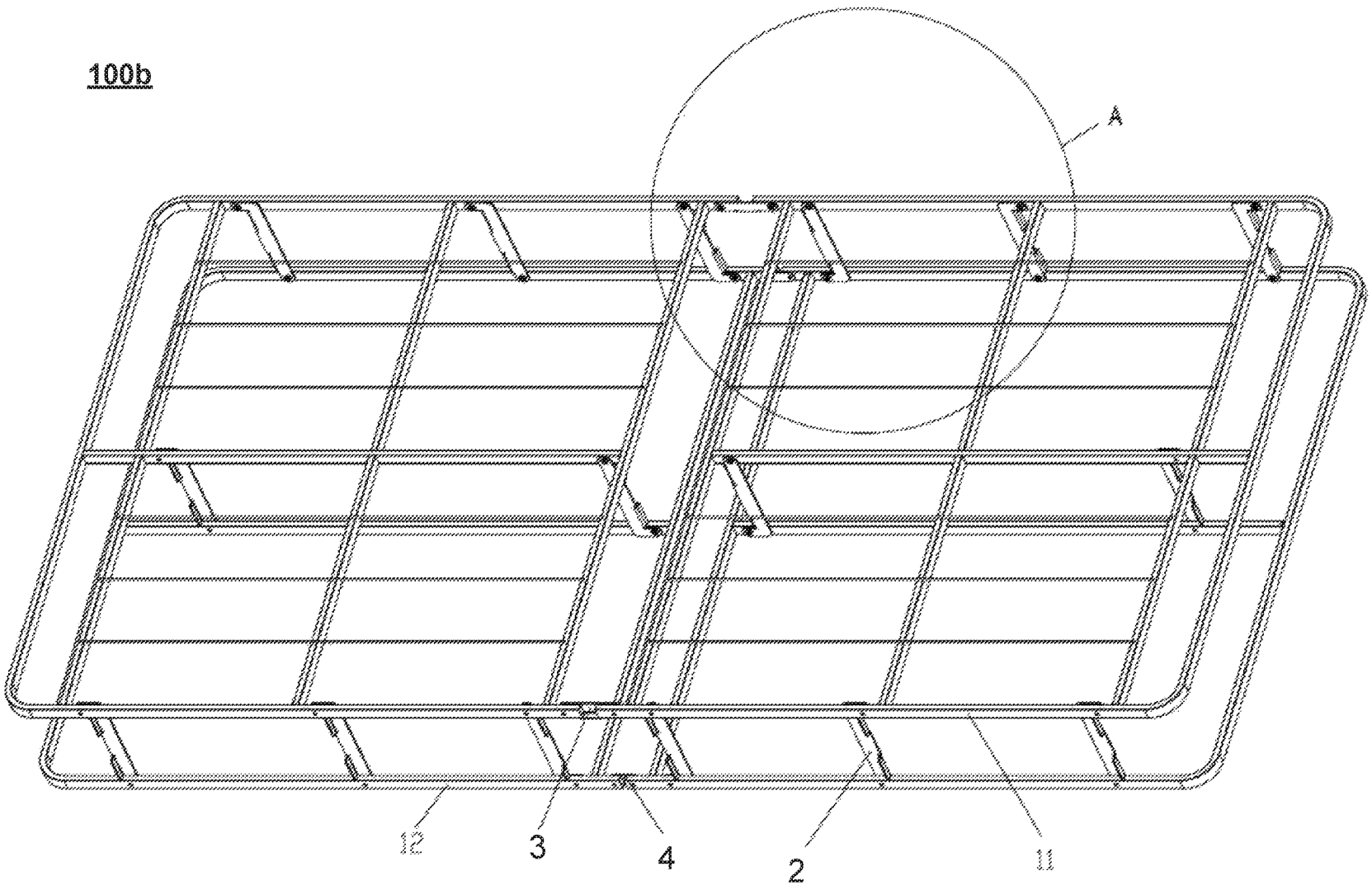
FIG. 8 is a schematic perspective view illustrating an exemplary foldable supporting frame in an unfolded state in accordance with some embodiments of the present invention.

Referring to FIGS. 7A and 7B, in some embodiment, the first segment of a support is formed with a raised or recessed terrace such as terrace 24. The support with terrace 24 can be placed adjacent the proximal ends to the frame units and terrace 24 can be used for connecting with the lower link. For example, FIGS. 1 and 3 illustrate such a support, e.g., support 2A, connected to lower link 4. In some embodiments, terrace 24 is formed with a through hole for connecting with the lower link.

Figure 9:
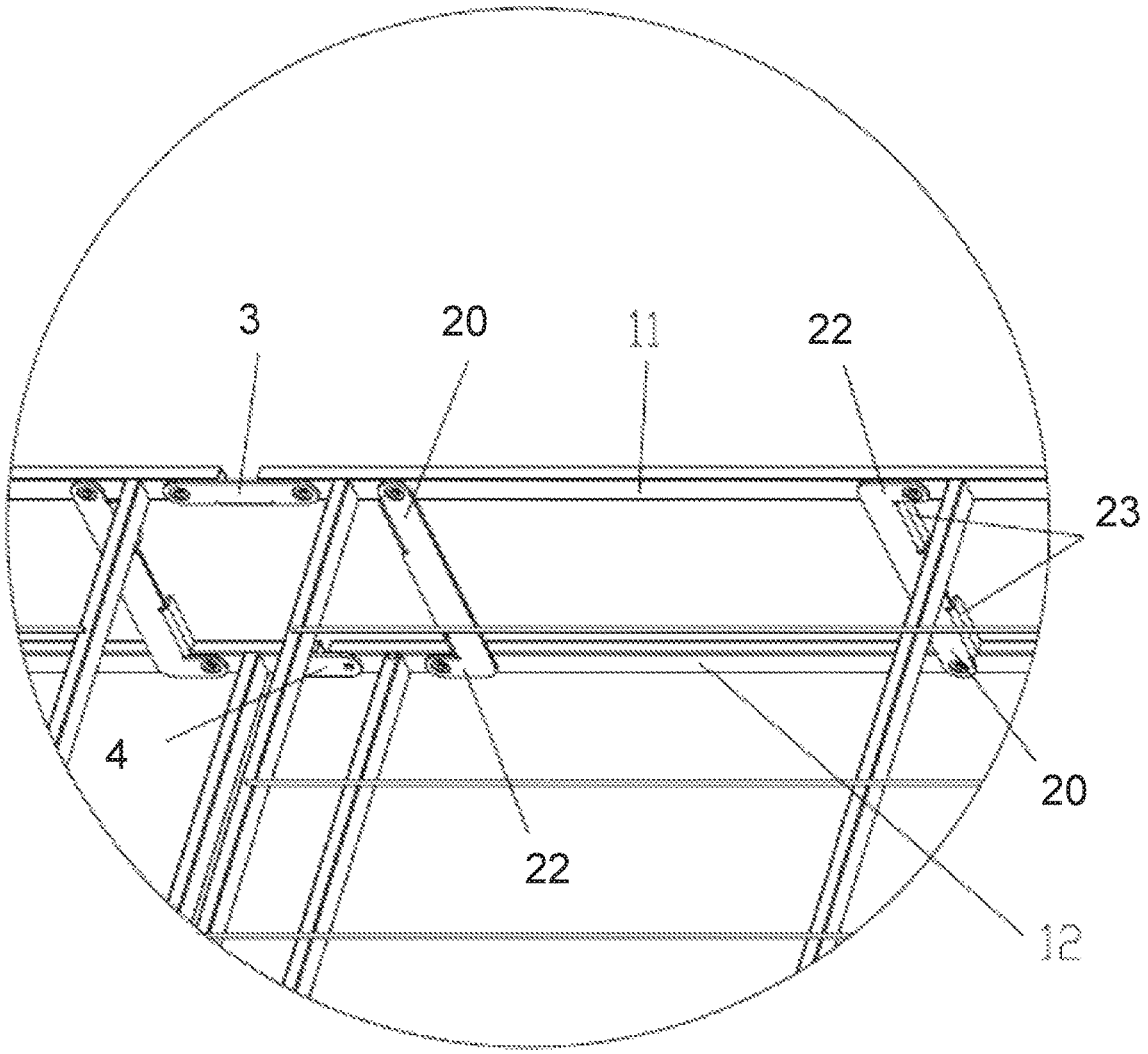
FIG. 9 is an enlarged view taken along circle A in FIG. 8.

The support can be disposed in various directions as long as one of the first and second segments is connected to the upper frame and the other of the first and second segments is connected to the lower frame. In some embodiments such as those illustrated in FIGS. 1, 8 and 9, there is at least one support having the first segment pivotally connected to the upper frame and the second segment pivotally connected to the lower frame, and at least one support having the first segment pivotally connected to the lower frame and the second segment pivotally connected to the upper frame. In an exemplary embodiment, for example the embodiment illustrated in FIGS. 8 and 9, each support disposed adjacent the proximal ends has the first segment pivotally connected to the upper frame and the second segment pivotally connected to the lower frame, and each support disposed away from the proximal ends has the first segment pivotally connected to the lower frame and the second segment pivotally connected to the upper frame.

Figure 4:
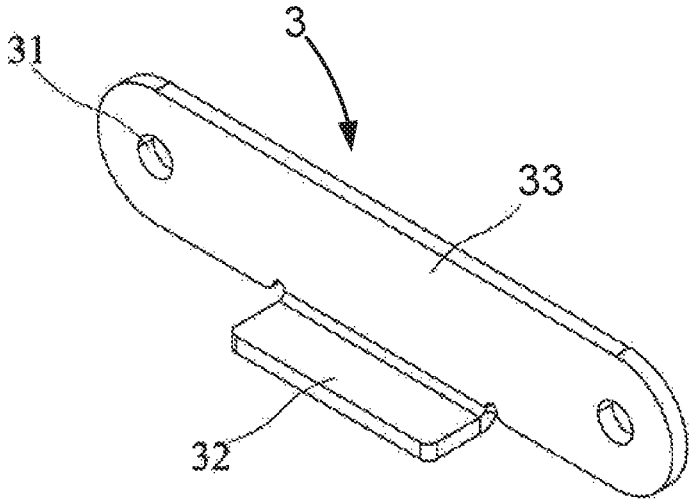
FIG. 4 is a schematic perspective view illustrating an exemplary upper link in accordance with some embodiments of the present invention.

Turning now to FIG. 4, there is depicted an upper link in accordance with some embodiments of the present invention. As shown, upper link 3 includes a first upper segment such as first upper segment 33 and a second upper segment such as second upper segment 32. First upper segment 33 is pivotally connected to the upper proximal ends of the first and second frame units. In some embodiment, second upper segment 32 is shorter than first upper segment 33.

In some embodiments, upper segment 33 is elongated in a longitudinal direction of the foldable supporting frame, and formed with a hole such as hole 31 at each side for pivotally connected to the upper proximal end of the first or second frame unit. The location at which the upper segment and the upper proximal end of the first frame unit are connected is referred to as the first upper pivot point. The location at which the upper segment and the upper proximal end of the second frame unit are connected is referred to as the second upper pivot point.

In an exemplary embodiment, second upper segment 32 is perpendicular to first upper segment 33, formed for example by bending. When the foldable supporting frame is unfolded, second upper segment 32 is disposed below the upper proximal ends of the first and second frame units, and supports the upper proximal ends of the first and second frame units.

Figure 5:
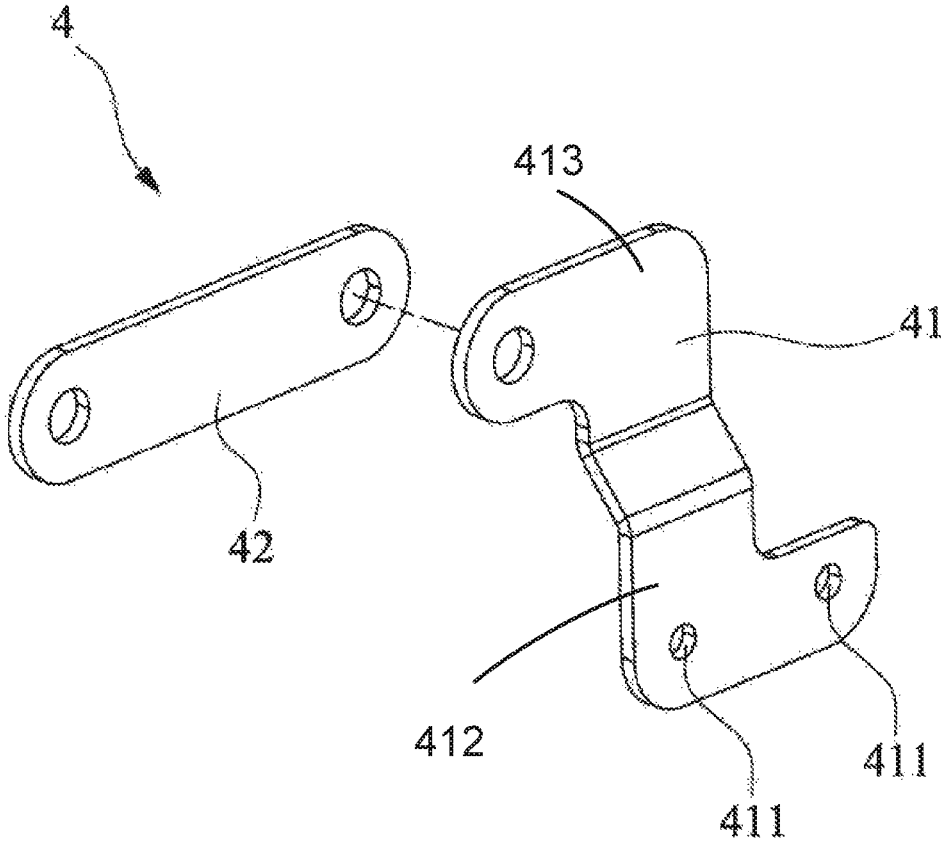
FIG. 5 is a schematic perspective view illustrating an exemplary lower link in accordance with some embodiments of the present invention.

Referring to FIG. 5, in some embodiments, lower link 4 includes a first lower piece such as first lower piece 41 and a second lower piece such as second lower piece 42. First lower piece 41 includes a lower segment such as lower segment 412 and an upper segment such as upper segment 413. Lower segment 412 is pivotally connected to the lower proximal ends of the first and second frame units. In some embodiments, second lower piece 42 has a first end pivotally connected to the upper segment of the first lower piece and a second end pivotally connected to a support adjacent the lower proximal end of the first or second frame unit.

In some embodiments, lower segment 412 is formed with a hole such as hole 411 at each side for pivotally connected to the lower proximal end of the first or second frame unit. The location at which the lower segment and the lower proximal end of the first frame unit are connected is referred to as the first lower pivot point. The location at which the lower segment and the lower proximal end of the second frame unit are connected is referred to as the second lower pivot point. In some embodiments, a distance between the first upper pivot and the second upper pivot is longer than a distance between the first lower pivot and the second lower pivot.

In some embodiments, lower segment 412 and upper segment 413 of first lower piece 41 collectively form a "Z" shape. In some embodiments, the first lower piece is bent such that the lower and upper segments of the first lower piece form a step.

In some embodiments, lower link 4 is configured to have a structure similar to upper link 3. For example, FIGS. 8-14 illustrate lower link 4 having a first lower segment such as first lower segment 45 and a second lower segment such as second lower segment 46. First lower segment 45 is pivotally connected to the lower proximal ends of the first and second frame units. The location at which the lower segment and the lower proximal end of the first frame unit are connected is referred to as the first lower pivot point. The location at which the lower segment and the lower proximal end of the second frame unit are connected is referred to as the second lower pivot point. In a preferred embodiment, such as the one illustrated in FIG. 13, the distance between the first upper pivot and the second upper pivot (e.g., L1) is longer than the distance between the first lower pivot and the second lower pivot (e.g., L2).

In a preferred embodiment, second lower segment 46 is perpendicular to first lower segment 45. When the foldable supporting frame is unfolded, second lower segment 46 is disposed below the lower proximal ends of the first and second frame units, and supports the lower proximal ends of the first and second frame units.

Figure 10:
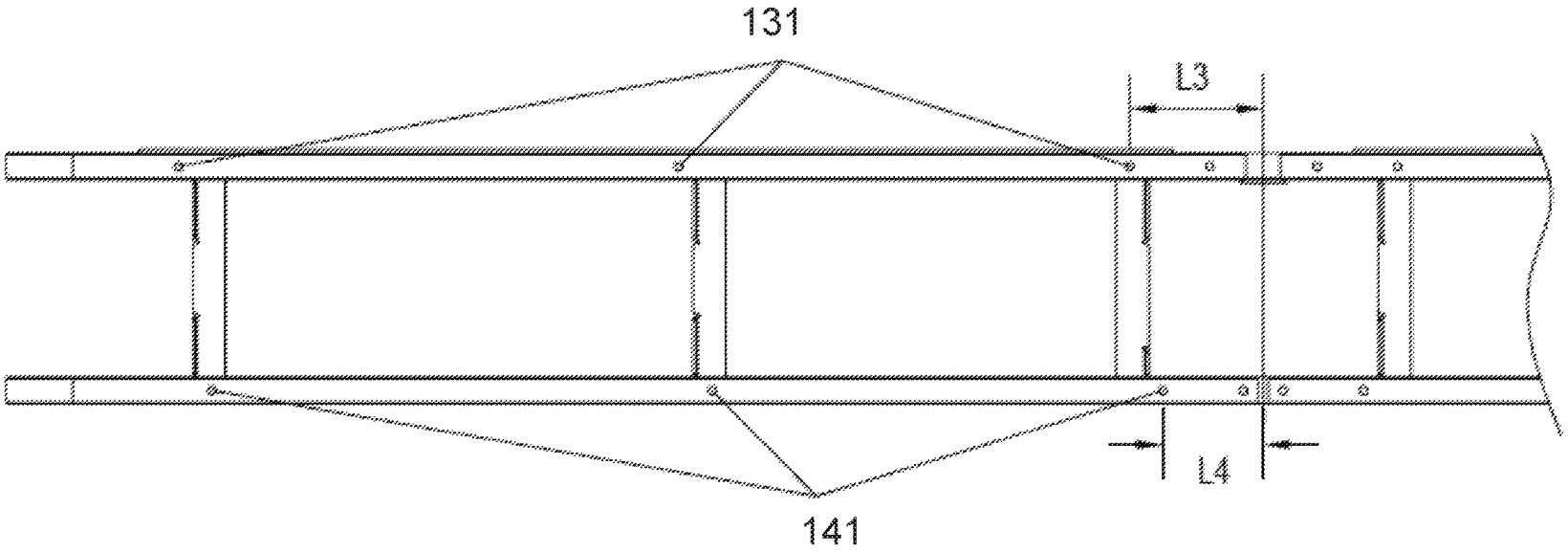
FIG. 10 is a schematic side view illustrating a portion of the exemplary foldable supporting frame of FIG. 8 in an unfolded state in accordance with some embodiments of the present invention.
Figure 11:
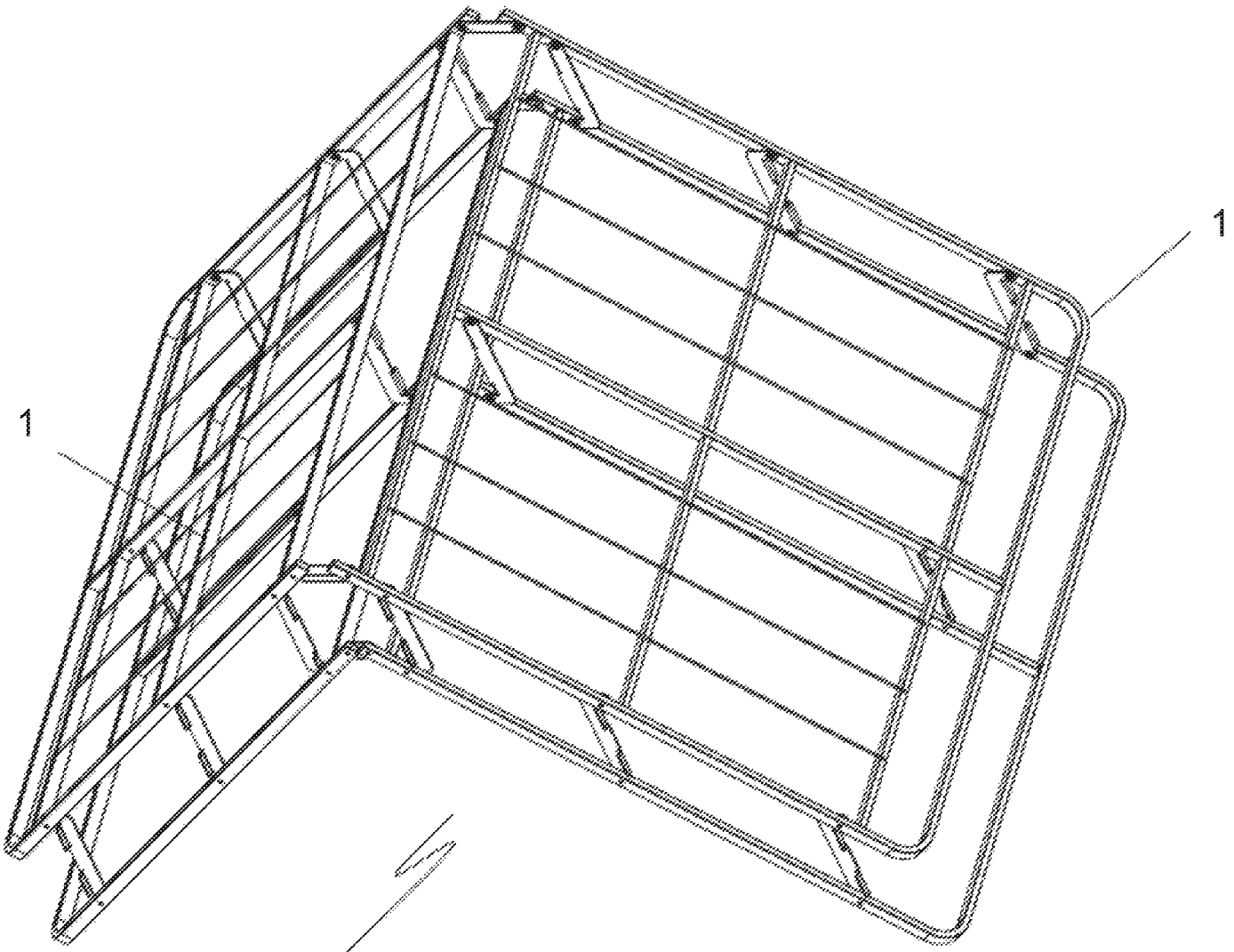
FIG. 11 is a schematic perspective view illustrating the exemplary foldable supporting frame of FIG. 8 between an unfolded state and a folded state in accordance with some embodiments of the present invention.
Figure 12:
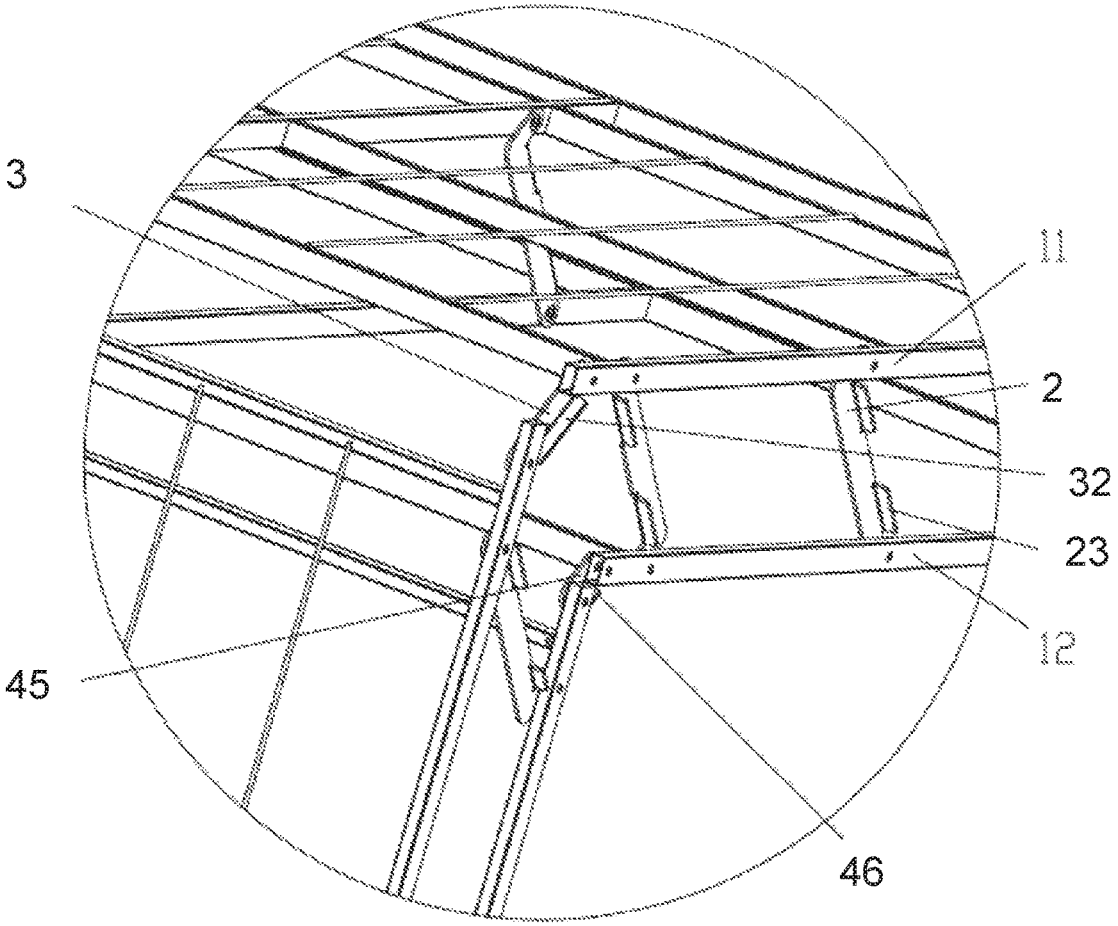
FIG. 12 is a schematic perspective view illustrating a portion of the exemplary foldable supporting frame of FIG. 8 between an unfolded state and a folded state in accordance with some embodiments of the present invention.
Figure 13:
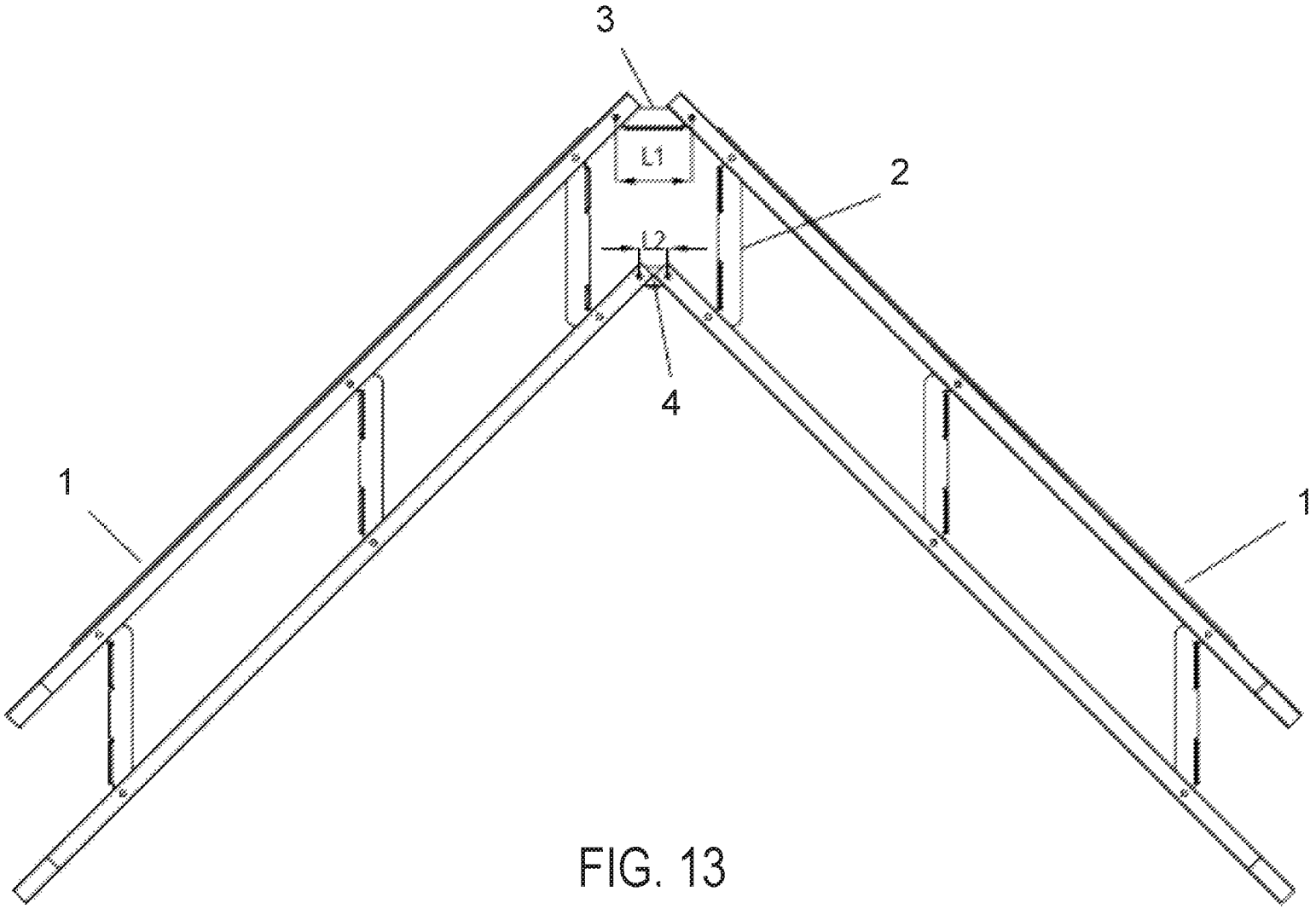
FIG. 13 is a schematic side view illustrating the exemplary foldable supporting frame of FIG. 8 between an unfolded state and a folded state in accordance with some embodiments of the present invention.
Figure 14:
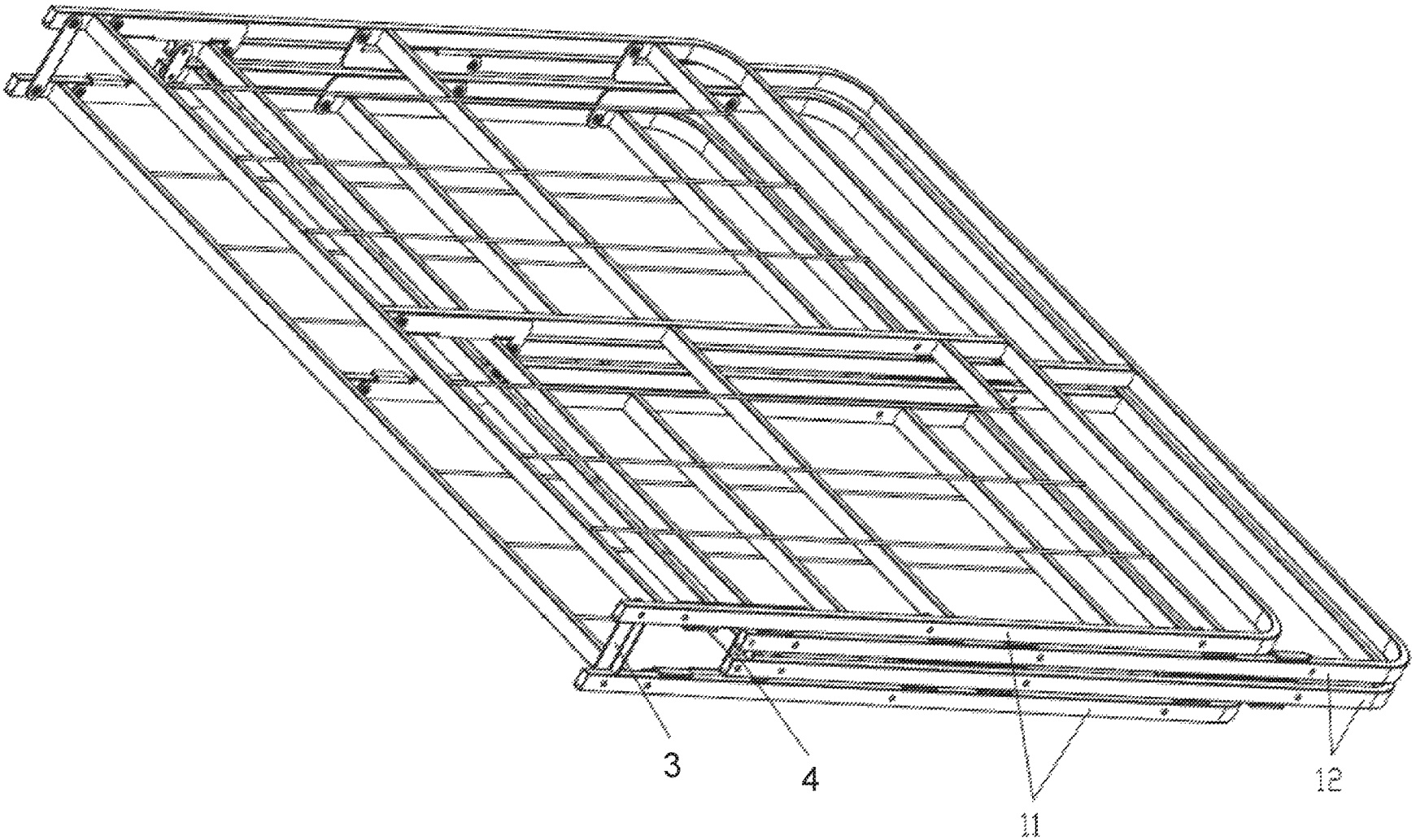
FIG. 14 is a schematic perspective view illustrating the exemplary foldable supporting frame of FIG. 8 in a folded state in accordance with some embodiments of the present invention.

In some embodiments, to facilitate connections with the plurality of supports, the upper and lower frames (e.g., the longitudinal bars) are formed with holes. For example, FIG. 10 illustrates holes 131 formed on the upper frame and holes 141 formed on the lower frame. In an exemplary embodiment, hole 141, formed on the lower frame adjacent the lower proximal end, is positioned closer to a central line than hole 131 formed on the upper frame adjacent the upper proximal end, as indicated by L4 and L3 in FIG. 10. It should be noted that the central line is not necessary the center of the foldable supporting frame unless the first and second frame units are identical and positioned symmetrically.

As disclosed herein, the upper and lower frames of the first and second frame units are pivotally connected to each other through upper link 3 and lower link 4, which are separated from each other. As a result, the overall weight of the supporting frame is reduced. Moreover, separated upper link 3 and lower link 4 allow the first and second frame units to rotate toward or away from each other more smoothly. They also allow the first and second frame units to fold onto each other more tightly, resulting in a more compact folded supporting frame and thus easier to handle, package, store, and transport. In addition, the supports hold the upper frame and prevent it from further unfolding, collapsing, swaying or any undesired movement when the supporting frame is unfolded or in use. In various embodiments, the supports hold the upper frame and maintain the upper and lower frames substantially flat and substantially parallel to each other. Accordingly, the foldable frame is stable and comfortable to use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", "left" or "right", "lateral" or "longitudinal" and etc. are used to describe features of the exemplary embodiments with reference to the positions of such features as displayed in the figures. It will be understood that, although the terms "first,"

"second," etc. may be used herein to describe various elements, these elements should not be limited by these terms. These terms are only used to distinguish one element from another. For example, a first segment could be termed a second segment, and, similarly, a second segment could be termed a first segment, without changing the meaning of the description, so long as all occurrences of the "first segment" are renamed consistently and all occurrences of the "second segment" are renamed consistently.

What is claimed is:

1. A foldable supporting frame, comprising:

first and second frame units, each comprising:

an upper frame having an upper proximal end at each of left and right sides of the foldable supporting frame;

a lower frame disposed below the upper frame when the foldable bed frame is unfolded, the lower frame having a lower proximal end at each of the left and right sides of the foldable supporting frame; and a plurality of supports pivotally connected to the upper and lower frames and supporting the upper frame when the foldable supporting frame is unfolded; and a plurality of links comprising an upper link and a lower link at each of the left and right sides of the foldable supporting frame, and pivotally connecting the first and second frame units, wherein:

the upper link pivotally connected to the upper proximal ends of the first and second frame units; and a lower link separated from the upper link and pivotally connected to the lower proximal ends of the first and second frame units, wherein the lower link comprises:

a first lower piece having a lower segment and an upper segment, wherein the lower segment is pivotally connected to the lower proximal end of the first frame unit at a first lower pivot point of the lower segment, and pivotally connected to the lower proximal end of the second frame unit at a second lower pivot point of the lower segment; and a second lower piece having a first end pivotally connected to the upper segment of the first lower piece and a second end pivotally connected to a support adjacent the lower proximal end of the first or second frame unit.

2. The foldable supporting frame 1, wherein the upper link comprises:

a first upper segment elongated in a longitudinal direction of the foldable supporting frame, pivotally connected to the upper proximal end of the first frame unit at a first upper pivot point, and pivotally connected to the upper proximal end of the second frame unit at a second upper pivot point; and a second upper segment substantially perpendicular to the first upper segment, disposed below the upper proximal ends of the first and second frame units when the foldable supporting frame is unfolded, and supports the upper proximal ends of the first and second frame units.

3. The foldable supporting frame of claim 2, wherein a distance between the first upper pivot and the second upper pivot is longer than a distance between the first lower pivot and the second lower pivot.

4. The foldable supporting frame of claim 1, wherein the upper frame comprises an upper peripheral frame made of a bent bar, and the lower frame comprises a lower peripheral frame made of a bent bar.

5. The foldable supporting frame of claim 1, wherein:

the upper frame comprises an upper peripheral frame and at least one upper interior bar; and the lower frame comprises a lower peripheral frame and at least one lower interior bar.

6. The foldable supporting frame of claim 1, wherein:

the upper frame is formed with a hole adjacent the upper proximal end for connecting with a support;

the lower frame is formed with a hole adjacent the lower proximal end for connecting with the support, wherein the hole of the lower frame is positioned closer to a central line than the hole of the upper frame.

7. The foldable supporting frame of claim 1, wherein the lower and upper segments of the first lower piece collectively form a "Z" shape.

8. The foldable supporting frame of claim 1, wherein the first lower piece is bent such that the lower and upper segments of the first lower piece form a step.

9. The foldable supporting frame of claim 1, wherein a support in the plurality of supports comprises a first segment and a second segment collectively forming a substantial "L" shape.

10. The foldable supporting frame of claim 9, wherein the support further comprises one or more third segments extended and bent from an edge of the first segment, wherein the second segment and the one or more third segments are located on the same side of the first segment, wherein the one or more third segments abut the upper and lower frames when the foldable supporting frame is unfolded.

11. The foldable supporting frame of claim 9, wherein at least one support has the first segment pivotally connected to the upper frame, and the second segment pivotally connected to the lower frame.

12. The foldable supporting frame of claim 9, wherein at least one support has the first segment pivotally connected to the lower frame, and the second segment pivotally connected to the upper frame.

13. The foldable supporting frame of claim 9, wherein:

each support disposed adjacent the proximal ends has the first segment pivotally connected to the upper frame, and the second segment pivotally connected to the lower frame; and each support disposed away from the proximal ends has the first segment pivotally connected to the lower frame, and the second segment pivotally connected to the upper frame.

14. The foldable supporting frame of claim 9, wherein the first segment of a support adjacent the proximal ends is formed with a raised or recessed terrace for connecting with the lower link.

15. The foldable supporting frame of claim 1, wherein the upper frame of each of the first and second frame units further comprises an upper interior longitudinal bar having an upper interior proximal end between left and right sides of the foldable supporting frame.

16. The foldable supporting frame of claim 15, wherein the plurality of links further comprises an upper interior link pivotally connected to the upper interior proximal ends of the first and second frame units.

17. The foldable supporting frame of claim 1, wherein:

the upper frame comprises a plurality of longitudinal upper bars;

the lower frame comprises a plurality of longitudinal lower bars corresponding to the plurality of longitudinal upper bars, wherein each support in the plurality of supports is disposed between a longitudinal upper bar and a corresponding longitudinal lower bar and pivotally connected to the longitudinal upper and lower bars.

* * * * *